US008378926B2

(12) United States Patent
Wada et al.

(10) Patent No.: US 8,378,926 B2
(45) **Date of Patent: *Feb. 19, 2013**

(54) COLOR DISPLAY DEVICE AND COLOR DISPLAY METHOD

(75) Inventors: Osamu Wada, Ima (JP); Junichi Nakamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/465,505

(22) Filed: May 7, 2012

(65) Prior Publication Data

US 2012/0218281 A1 Aug. 30, 2012

Related U.S. Application Data

(60) Continuation of application No. 13/113,625, filed on May 23, 2011, now Pat. No. 8,199,071, which is a continuation of application No. 12/885,052, filed on Sep. 17, 2010, now Pat. No. 7,969,385, which is a continuation of application No. 12/645,132, filed on (Continued)

(30) Foreign Application Priority Data

Dec. 1, 1998 (JP) ..... 10-342217
Dec. 1, 1998 (JP) ..... 10-342218

(51) Int. Cl.
*G09G 3/00* (2006.01)

(52) U.S. Cl. ..... 345/32; 345/88

(58) Field of Classification Search ..... 345/32, 345/88; 349/106; 353/84; 348/743
See application file for complete search history.

(56) References Cited

U.S. PATENT DOCUMENTS

| | | | |
|---|---|---|---|
| 5,113,332 | A | 5/1992 | Richardson |
| 5,448,314 | A | 9/1995 | Heimbuch et al. |
| 5,684,498 | A | 11/1997 | Welch et al. |
| 5,706,061 | A | 1/1998 | Marshall et al. |
| 5,825,337 | A | 10/1998 | Wiseman et al. |
| 5,828,362 | A | 10/1998 | Takahashi et al. |
| 5,844,538 | A | 12/1998 | Shiraki et al. |
| 5,959,598 | A | 9/1999 | McKnight |
| 6,005,616 | A | 12/1999 | Itoh et al. |
| 6,222,512 | B1 | 4/2001 | Tajima et al. |
| 6,281,949 | B1 | 8/2001 | Matsui et al. |
| 6,297,907 | B1 | 10/2001 | Wang |
| 6,330,039 | B2 | 12/2001 | Matsui et al. |
| 6,392,656 | B1 | 5/2002 | Someya et al. |
| 6,825,823 | B1 | 11/2004 | Taira et al. |
| 7,508,357 | B2 | 3/2009 | Wada et al. |

FOREIGN PATENT DOCUMENTS

| | | | |
|---|---|---|---|
| EP | 0 749 201 | A1 | 12/1996 |
| EP | 0 749 248 | A1 | 12/1996 |
| EP | 0 662 773 | A1 | 7/1998 |

(Continued)

OTHER PUBLICATIONS

Office Action dated Aug. 16, 2011 for Japanese Patent Application No. 2008-283272 (with translation).

(Continued)

*Primary Examiner* — Ricardo L Osorio
(74) *Attorney, Agent, or Firm* — Oliff & Berridge, PLC

(57) ABSTRACT

The color display device includes a colored light generation unit for repetitively generating a plurality of colored lights in a time sequence with a predetermined frequency, and an image generation unit for processing said plurality of colored lights, so as to generate an image corresponding to each of the plurality of colored lights generated in a time sequence. The said predetermined frequency is 180 Hz or more.

20 Claims, 12 Drawing Sheets

Related U.S. Application Data

Dec. 22, 2009, now Pat. No. 7,821,476, which is a continuation of application No. 12/320,972, filed on Feb. 10, 2009, now Pat. No. 7,663,572, which is a division of application No. 12/003,583, filed on Dec. 28, 2007, now Pat. No. 7,508,357, which is a division of application No. 11/727,509, filed on Mar. 27, 2007, now Pat. No. 7,333,074, which is a continuation of application No. 11/110,675, filed on Apr. 21, 2005, now Pat. No. 7,224,328, which is a continuation of application No. 09/601,246, filed as application No. PCT/JP99/06746 on Dec. 1, 1999, now Pat. No. 6,972,736.

FOREIGN PATENT DOCUMENTS

| | | |
|---|---|---|
| JP | A-05-080717 | 4/1993 |
| JP | A-06-273719 | 9/1994 |
| JP | A 7-199149 | 8/1995 |
| JP | A-07-333574 | 12/1995 |
| JP | A 8-51633 | 2/1996 |
| JP | A 08-152598 | 6/1996 |
| JP | A 08-160382 | 6/1996 |
| JP | A 08-304720 | 11/1996 |
| JP | A 08-317380 | 11/1996 |
| JP | A-09-065369 | 3/1997 |
| JP | A-09-073061 | 3/1997 |
| JP | 10-161597 | 6/1998 |
| JP | A 10-254390 | 9/1998 |
| JP | A 10-326080 | 12/1998 |
| JP | A 11-239359 | 8/1999 |

OTHER PUBLICATIONS

Office Action dated Oct. 18, 2011 issued in Japanese Patent Application No. 2008-130865 (with translation).

Office Action dated Oct. 3, 2011 issued in U.S. Appl. No. 13/113,625.

Fig. 3 RELATIONSHIPS OF FRAME FREQUENCY AND VISUAL SYSTEM COLOR SPACE FREQUENCY

COLOR DISPLAY DEVICE AND COLOR DISPLAY METHOD

This is a Continuation of application Ser. No. 13/113,625 filed May 23, 2011, which is a continuation of Ser. No. 12/885,052 filed Sep. 17, 2010, which is a continuation of Ser. No. 12/645,132, filed Dec. 22, 2009, which is a continuation of Ser. No. 12/320,972, filed Feb. 10, 2009, which in turn is a Division of application Ser. No. 12/003,583 filed Dec. 28, 2007 (now U.S. Pat. No. 7,508,357, issued Mar. 24, 2009), which is a Division of application Ser. No. 11/727,509, filed Mar. 27, 2007 (now U.S. Pat. No. 7,333,074, issued Feb. 19, 2008), which is a Continuation of application Ser. No. 11/110,675, filed Apr. 21, 2005 (now U.S. Pat. No. 7,224,328, issued May 29, 2007), which is a Continuation of application Ser. No. 09/601,246 filed Jul. 31, 2000 (now U.S. Pat. No. 6,972,736, issued Dec. 6, 2005), which is a National Stage of PCT/JP99/06746 filed Dec. 1, 1999. The disclosure of the prior applications is hereby incorporated by reference herein in its entirety.

BACKGROUND

The present invention relates to a color display device for and a color display method of implementing a color image generation that is time-division driven.

Color display device, which implement a color display with an additive mixture of color stimuli according to a time difference color mixture, i.e., a time division driving system within a single dot, have recently received attention. In such color display devices, because one pixel becomes one picture element, there is an advantage in that a threefold resolution can be obtained compared to color display devices that implement a color mixture juxtaposition. One of the color display devices of the time division driving system such as described above, is known as a DMD projector which displays a color image by irradiating colored lights of R (Red), G (Green), and B (Blue) that are generated by a light from a white color light source being passed through a rotating color filter disk the Texas Instruments Incorporated. Ltd.) in a time sequence and by projecting the colored lights modulated/reflected with this DMD array onto a screen. Further, other than the above, there is a color liquid crystal display device and the likes in which the color light source for generating the colored lights of R, G, B source is arranged behind the liquid crystal panel that implements a black and white display.

SUMMARY

However, in the color display devices such as the DMD projector and the color liquid display device, which are time-division driven as described above, when an eye (or eyes) of an observer follows the subject image that crosses over a screen or a display, for example, it has a problem that the observer perceives a color separation. As a result, there is a problem that a color displacement occurs on the observed image and thereby deteriorates the display quality.

In addition, in the case of the projection display device that is time-division driven (i.e., a DMD projector and a liquid crystal projector), there is a problem that an observer perceives a color separation as being caused by an action that is to be conducted by a presenter situated in front of a screen for example, indicating on the screen with an indication stick or a finger and an action of crossing over in front of the screen. Accordingly, there is a problem such that color displacement occurs on the observed image thereby deteriorating a display quality, and the observer perceives a feeling of a fatigue and the like. Further, it has been reported that a similar perception of a color display also occurs in an image pickup device.

In general, when watching an image generated by the color display device of the time-division driving system, it is known that the color band of the colored lights of R (Red), G (Green), B (Blue) formed physically on a retina (or retinas) by voluntarily or involuntarily occurring eye movement, are caused by a phenomena (hereinafter, it is referred to as a color breakup) in which a resulting color separation is psychologically perceived.

Now, it is described about the color breakup that is generated as being caused by the eye movement of human beings. FIG. 12 shows a mechanism with which the color band of RGB colored lights are physically formed on the retina by the voluntarily or involuntarily occurring eye movement, at a time when seeing the original RGB image that is created by driving three colored lights in a time sequence (hereinafter, it is referred to as a color sequence). In the color display device that is time-division driven, a R image, a G image, and a B image are generated without any spatial phase displacement by synchronizing-signal processing the respective RGB colored lights and the images corresponding thereto. A human being recognizes the respective color images of these RGB as the color images that are equivalent to the original images by additive mixing of color stimuli time-integrally with a visual center of higher order. However, during the image observation in practice, human being conducts a line of sight shift and a blink unconsciously or consciously. At that moment, the respective images of RGB that are generated time-integrally by the color sequence driving are influenced spatially by the eye movements, and the color band of RGB is physically formed on the retina as shown in FIG. 12, and as being caused thereby they are perceived as color breakup by the optic nerve.

In the following, with reference to FIG. 13, an actual model (time-space integral type additive mixture of color stimuli) and an ideal model (time integral type additive mixture of color stimuli) of the color images that are generated on the retina by the color sequence driving are described in comparison. In the figure, a vertical axis represents time and a horizontal axis represents space. Further, although the figure shows the three-frame images, in the color image with the color sequence driving, the system which color-composes the R image, the G image, the B images that are generated on the retina with a time-difference uniquely determined by the frame frequency with the optic nerve. Accordingly, as shown on the left side in the figure, but for the ideal where no displacement occurs spatially, the R image, the G image, the B images (for example, AR image, AG image, AB image) that form one frame are generated on the retina with the time-difference uniquely determined by the frame frequency. However, as the eye movement participates in practice, as shown on the right side in the figure, a time-difference in which the R image, the G image, the B images (for example, AR' image, AG' image, AB' image) that form one frame are determined uniquely by the frame frequency, and a spatial position displacement that is determined uniquely by the eye movement rate are to be generated on the retina simultaneously. This phenomena occurs only when eye movement is generated, and does not occur at a time when the eyeball is in a stationary state or in a relative stationary state (for example, in a state as following a movement of a fly). Further, the generation situation differs depending on the direction of the eye movement (for example, the AR' image, AG' image, AB' image that are the first frame on the right side of FIG. 13, and the CR' image, CG' image, CB' image that are the third frame thereof are such that their generation directions thereof are reversed).

As described above, in the color display device of the time-division driving system (color sequence driving system), it is fundamental to generate color assuming the additive mixture of color stimuli type of time integration, but as the eye movement disproves this assumption, the fundamental (ideal) no longer holds, and there will be a perception problem of a psychological color breakup such as described above. FIG. 14 is an illustrative drawing showing a color image generation model according to a combination of the color sequence driving system as such and a visual system. As can be seen from the figure, in the color image generation according to the color sequence driving system, it is required to develop a color display device by considering the eye movement of the human factor 1 and the psychological color breakup perception of the human factor 2. Particularly, in the projection type display device, upon considering these human factors, it will be an object to control a generation of the color breakup that is perceived as being caused by an action and the like performed by a presenter who performs a presentation standing in front of a screen.

It is realized that such color breakup can be configured so as not to be perceived, by physically narrowing the width of the color band, by contracting the time difference of three colored lights, by increasing the frame frequency to about 2000 Hz-3000 Hz, but for the frame frequency of about 120 Hz in the present situation, the image generation drive and the color generation drive with the higher frame frequency such as 2000 Hz-3000 Hz are difficult in practice.

The present invention is made in light of the above-mentioned problems, and an object of the present invention is to provide a color display device of a time-division driving system and a color display method thereof, in which there occurs no perception of a color breakup caused by an action performed by a presenter, as well as the perception of a color breakup caused by eye movement.

The color display device of the present invention may consist of a colored light generation unit for repetitively generating a plurality of colored lights in a time sequence with a predetermined frequency and an image generation unit for processing the plurality of colored lights, so as to generate an image corresponding to each of the plurality of colored lights is generated in a time sequence, wherein the predetermined frequency is 180 Hz, thereby achieving the above-mentioned objects.

Preferably, the predetermined frequency is 250 Hz.

More preferably, the predetermined frequency is 300 Hz.

In some aspect of the embodiments, the colored light generation unit may consist of a light source, and a color filter for generating the plurality of colored lights from light coming from the light source.

In other aspect of the embodiments, the colored light generation unit may consist of a plurality of light sources for emitting colored lights different from each other, wherein the plurality of light sources turn on in a time sequence.

In some aspect of the embodiments, the image generation unit is a reflected type electro-optical device, according to any of the color display device in the above exemplary embodiments.

In a further aspect of the embodiments, the electro-optical device is a liquid crystal device.

In a further aspect of the embodiments, the electro-optical device is a digital micro-mirror device.

In a further aspect of the embodiments, the image generation unit may consist of a transparent-type electro-optical device.

In a further aspect of the embodiments, the color display device further may consist of a lens for projecting the image.

A color display method of the present invention may consist of a colored light generation step for repetitively generating a plurality of colored lights in a time sequence with a predetermined frequency and an image generation step for processing the plurality of colored lights, so as to generate an image corresponding to each of the plurality of colored lights is generated in a time sequence, wherein the predetermined frequency is 180 Hz, thereby the above-mentioned object can be achieved.

Preferably the predetermined frequency is 250 Hz.

More preferably, the predetermined frequency is 300 Hz.

According to the present invention, as setting to a repetition frequency range of the colored lights in which a color identification in a visual system is lowered, for example, a color breakup that is caused by an action of a presenter who performs a presentation as standing in front of a screen or an object in front of the screen, to be perceived by an observer to be controlled or prevented. Further, it also prevents color breakup that is caused by an eye movement of an observer, to be perceived by the observer. In addition, it enables to drive with a repetition frequency to be driven in a practical range without drastically increasing the repetition frequency of the colored light generation of the color display device of the time-division driving system. As a result, according to the present invention, a person who watches a displayed image on a screen no longer has an incongruous sense of the image, and it has an advantage of enhancing the quality of an observed image while reducing the sense of fatigue accompanied by the image observation.

DETAILED DESCRIPTION OF THE EMBODIMENTS

Figure 1:
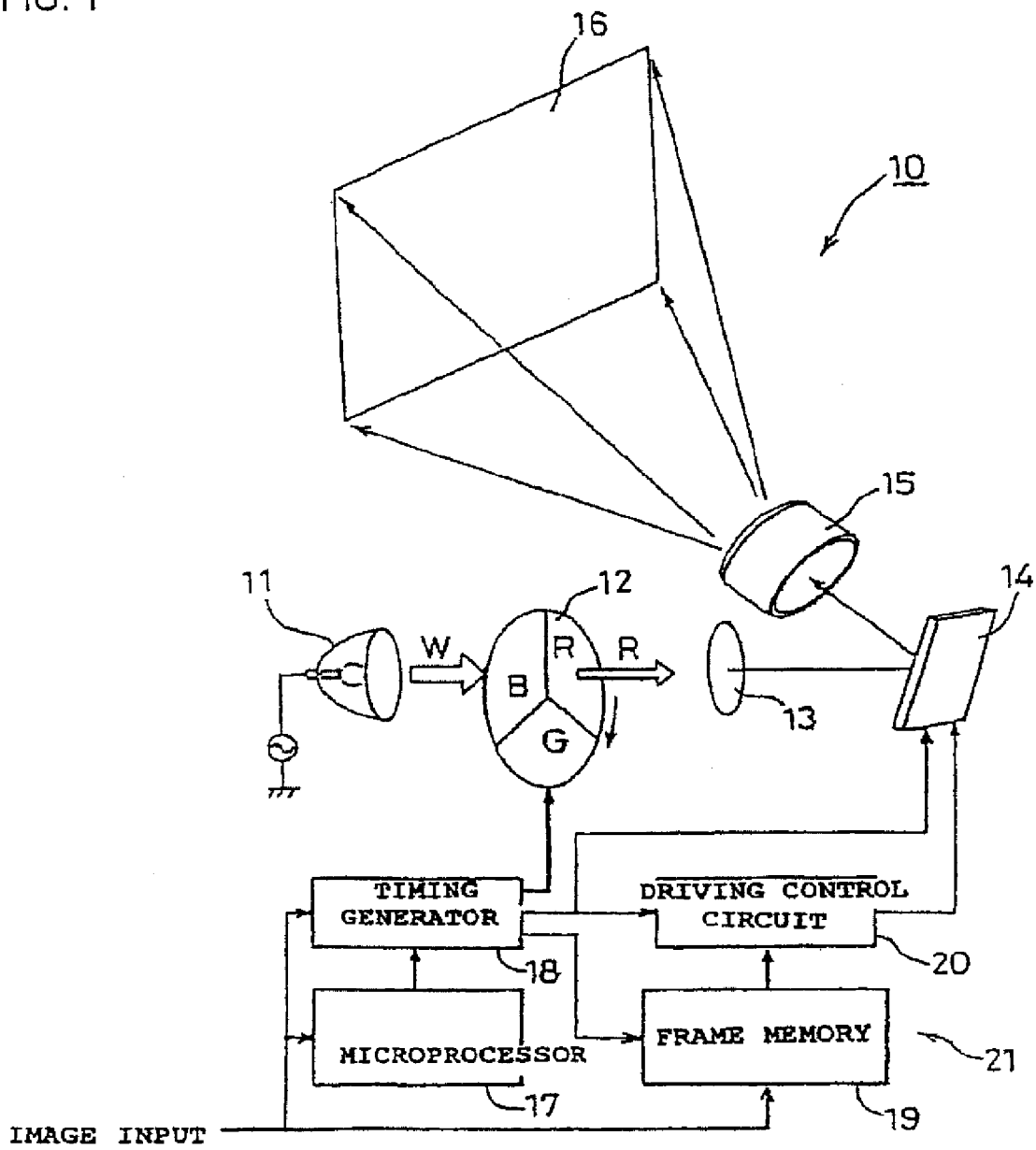
FIG. 1 is a drawing illustrating the configuration showing the first embodiment of the color display device according to the present invention.

Details of the color display device and the color display method of the present invention will be described based on the embodiments shown in the drawings.

(First Embodiment)

FIG. 1 shows a first embodiment of a color display device and a driving method of the color display device according to the present invention. As shown in the figure, the color display device 10 of the present embodiment is the color display device that may consist of a light source 11 for emitting a white light which includes the respective spectra of a red colored light, a blue colored light and a green colored light, a rotary color filter 12 being disposed in front of this light source 11 and having the areas of color elements for the red, blue and green, a condenser lens 13 being disposed in front of the rotary color filter 12, an electro-optical device 14 for generating a color image corresponding to a color of a colored light incident through the condenser lens 13, and a projection lens 15 for performing a projection upon receiving light that is reflected/modulated by the electro-optical device 14, and an image is displayed as an image generation colored light being projected from the projection lens 15 onto a screen 16. In the light source 11, a reflector 11*a* for reflecting a light from the light source as shown is also provided.

An observer who watches an image projected onto the screen might watch the projected image as situated in front of the screen 16 if the color display device is a front projection type, or situated in rear of the screen 16 if the color display device is a rear projection type. In a presentation using a color display device, a presenter (human being) stands in front of the screen 16 as viewed by the observer, and describes as pointing out the projected display screen, using an object such as a finger or an indication stick. Accordingly, from a view point of the observer, an action of the presenter or the object in front of the screen 16 is performed as blocking the display screen. Conventionally, a color breakup phenomenon has occurred in accordance with this action.

One of the advantages of the present invention is to solve the perception problem of the conventional color breakup as such, a detailed configuration for this will be described below.

The various kinds of modulators for the above-mentioned electro-optical device 14, have a high-speed response characteristic, such as a ferroelectric liquid crystal panel, an antiferroelectric liquid crystal panel, a liquid crystal panel of a $\pi$ cell mode, a liquid crystal panel in which a cell gap of a TN liquid crystal cell is set to be narrowed, and a liquid crystal panel of a OCB mode and the likes as a DMD array, or a reflection type liquid crystal light valve, can be applied thereto.

Further, the color display device 10 as such mainly consists of a driving circuit 21 constituted of a microprocessor 17, a timing generator 18, a frame memory 19, and a driving control circuit 20. In this color display device 10, it is controlled by synchronizing a rotary drive of the rotary color filer 12 and a driving timing of the reflection type electro-optic device 14 with the timing generator 18. First, an image signal is sampled with a sampling circuit which is not shown in the figure. Then, a synchronizing signal in the image input signal is sent to the microprocessor 17 as well as the timing generator 18. At the same time, it is arranged that an image data in the image signal is written into the frame memory 19 with a timing that is controlled by the timing generator 18. It is arranged that the white light emitted from the light source 11 passes through a three-color rotary color filter 12 that rotates in synchronization with the driving timing of the electro-optical 14 by the timing generator 18, the colored lights are generated by sequentially observing spectra passing through a red light filter, a blue light filter, and a green light filter from the light source, and then are irradiated onto the reflection type electro-optical device 14 through the condenser lens 13. For each of the colored lights irradiated as such, a light modulation is implemented and is enlarged and projected by the projection lens 15, and then is image-formed on the screen 16 so as to implement a color image display.

For example, for synchronizing with the timing of the light from the light source 11 which passes through a red zone of the rotary color filter 12, in response to the reading of the timing signal supplied from the timing generator 18, the image data of the red component that is stored previously during the prior driving period to the present is read sequentially, from the frame memory 19, and the driving control circuit 20 which receives the image data and drives each of the pixels of the electro-optical device 14 in response to the image data for use in the red component. The timing generator 18 implements a timing-control so as to synchronize the timing of the respective elements upon receiving a control of the microprocessor 17. The electro-optic device 14 is a modulation element which is constituted of a DMD or a liquid crystal panel as described above, and in which pixels constituted of reflection mirrors and/or reflection electrodes are arranged in a matrix, and a red light is reflected for each pixel, and a modulation is made with this reflection, and then a red colored image is generated. Accordingly, a red colored light for which a light intensity is modulated for each pixel is incident on the projection lens 15, and an image of a red colored light is projected and displayed on the screen 16.

Then, the image data for use in the blue colored light is read from the frame memory 19, and in response thereto, each pixel of the electro-optical device 14 is driven in response to the image data thereof, a blue colored light is modulated, and an image of a blue colored light is projected and displayed on the screen 16, in accord with the timing of the light from the light source which passes through a blue zone of the rotary color filter 12, similar to the case of the red colored light, Then, with a timing of which the light from the light source passes through a green zone of the rotary color filter 12, it is the same as above. As described above, images of three colored lights are generated sequentially with the electro-optical device 14, and by repeating this in a cycle, a color image is displayed. Further, the order of generating the colored lights is not limited to the present embodiment, it may be any order.

Herein, when the electro-optic device 14 is a DMD, the DMD modulates a quantity of light incident on the projection lens 15 by changing a tilted angle of the reflection mirror in response to the image data for each pixel. More particularly, it is arranged to enable to pulse-width modulate (PWM) a time width to direct the light reflected from the reflection mirror to the projection lens 15 and a time width to cause the light reflected to be absorbed into an absorber in response to the image data, and to modulate the intensity of colored lights for each pixel. Further, in the case of the DMD, it makes possible to install the frame memory 19 in the electro-optical device as a SRAM, and having an image memory for each pixel, and in response to a memory content thereof, it makes possible to cause a reflection mirror for each pixel to be angle-module-driven by the driving control circuit 20 that is installed for each pixel. Though, these memories and driving control circuits are disposed under the reflection mirrors.

Furthermore, when the electro-optical device 14 is a liquid crystal panel, the liquid crystal discussed previously is sandwiched between a pair of substrates, having a pixel electrode for each pixel in the substrate on the opposite side, and changing an effective voltage that is applied to a liquid crystal layer from this pixel electrode in response to the image data, then reflecting/emitting by changing a plane of polarization and/or the scattering angle of the incident light in response to a change in an array of liquid crystal molecules in the liquid crystal layer. Accordingly, when changing the plane of polarization, a light intensity is modulated for each pixel entering an incident light through a polarization element, and reflected light is directed to the projection lens 15 through the polarization element. When light scattering changes (in the case that the liquid crystal is a high polymer dispersion type), providing a slit before the projection lens 15 and causing to pass through it is similar to the DMD, a light intensity is modulated for each pixel. Also with the liquid crystal panel, as similar to the DMD, the memory (frame memory 19) and the driving control circuit 20 that applies a voltage to a pixel electrode in response to a memory content thereof for each pixel may be installed under the reflection type pixel electrode.

The color display device 10 of the present embodiment has the reflection type electro-optical device as the electro-optical device 14, but when using a liquid crystal device (liquid crystal panel), it may have a transparent type electro-optical device including a transparent type liquid crystal panel as the electro-optical device 14.

In the present embodiment as described above, the rotation rate is controlled by the timing generator 18 so that the repetition frequency (frame frequency) of the three colored lights of the rotary color filter 12 is equal to or greater than 180 Hz, preferably equal to or greater than 250 Hz, more preferably equal to or greater than 300 Hz. Also, the timing of color image generation of the electro-optical device 14 is set so as to match the generation timing of the respective colored lights.

In an aspect of the present embodiment, by performing color sequence driving with a frame frequency of 180 Hz or more, even if eye movement caused by an action of a presenter himself who performs a presentation as standing in front of the screen 16 or a finger thereof, or an object such as an indication stick is moved by the presenter occurs, perceived color breakup is reduced or eliminated. By performing color sequence driving with a frame frequency of 250 Hz or more, not only is the above-mentioned perceived color breakup due to the movement of the presenter prevented but also an observer's perceived color breakup caused by high speed eye movement is reduced or eliminated (to be described later). In this case, taking individual differences in the observers' perceptions into account, it is more preferable to perform color sequence driving with a frame frequency of 300 Hz or more.

Now, the reasons of reducing or eliminating the perception of color breakup such as in the present embodiment will be described based on the relations of the frame frequency and the color spatial frequency of the visual system.

Figure 2:
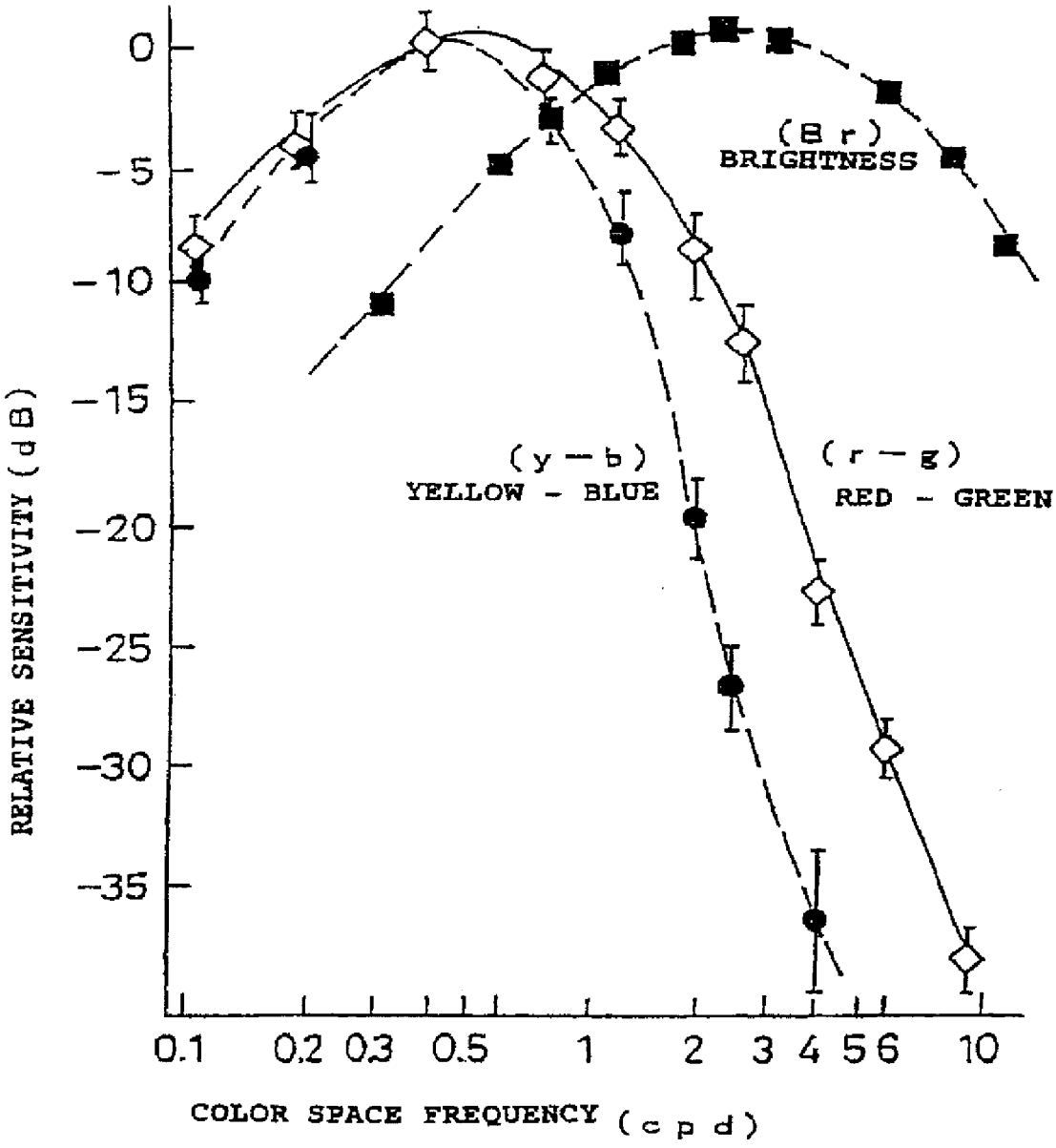
FIG. 2 is a graph showing the visual color spatial frequency characteristics.

First, referring to FIG. 2, the relations of the color spatial frequency of the visual system and the contrast (relative sensitivity) will be described. The figure is a known data described in "Television", 1977, vol. 31, No. 1, page 31. A horizontal axis of the graph in the figure indicates the color spatial frequency, represented in cycle/degree (cpd). A unit (cpd) of this color spatial frequency indicates a number of sine waves in a visual angle of 1 degree, and if there is 1 cycle of a sine wave in the visual angle of 1 degree it is said to be 1 cpd, and if there are 5 cycles of a sine wave in the visual angle of 1 degree it is said to be 5 cpd. Further, a vertical axis of this graph indicates the contrast sensitivity with the relative sensitivity (dB), and obtains the limit values of which a brightness discrimination and/or a color discrimination can not be performed. As shown in FIG. 2, in general, in a visual system of a human being, the sensitivity characteristic for brightness (light and dark) is that the contrast sensitivity characteristic is poor even when the spatial frequency is low or high, and a contrast sensitivity for the brightness is most pronounced around 4 cpd, at the middle. Further, although not shown in the figure, a cutoff frequency of the contrast sensitivity characteristic for this brightness is 60 cpd. On one hand, the sensitivity characteristic for color is similar in that a contrast sensitivity characteristic is poor even when the spatial frequency is low or high, and a contrast sensitivity of the color is most pronounced around 0.4 cpd that is the chromaticity spatial frequency at the middle. 0.4 cpd, is a result corresponding to the frame frequency 120 Hz in the calculation, and it can be said to be the worst condition when the human characteristic is taken into an account in view point of the color sequence driving system, which (in the projection type display device at the present time, there is one with a frame frequency of 120 Hz, in which color breakup is easily perceived). Further, though not shown in the figure, a cutoff frequency of the sensitivity characteristic for this color is 4-10 cpd.

In order to reduce or eliminate the color breakup, based on the known data as shown in FIG. 2, it is understood that providing a color spatial frequency of more than 0.4 cpd is required. The inventors of the present invention have found that providing the color spatial frequency of 0.5 cpd or more which is higher than 0.4 cpd that is this color spatial frequency, enables the reduction or elimination of generated perceived color breakup caused by an action of a person or an object that is located in front of the screen 16 as seen by an observer. Furthermore, preferably providing a color spatial frequency of 0.8 cpd or more, that is twice that of 0.4 cpd, enables not only the prevention of the perception of the above-mentioned color breakup, but also the reduction or elimination of the occurrence of perceived color breakup caused by high speed eye movement.

An exchange between the frame frequency and the color spatial frequency (the spatial frequency of the visual system) can be made using the following equations (1), (2) and (3).

$$Ft=(3*Ff)^{-1} \quad (1)$$

$$Cba=Rv*Ft \quad (2)$$

$$Vf=(3*Cba)^{-1} \quad (3)$$

Further, Ff is a frame frequency (Hz), and is a frequency at a time when generating 1 frame of a color image (1 scene of color). Cba is a color band visual angle (degree) that is formed by each of the colored lights, and is the one of which a color band width of 1 colored light is given by a visual angle. Further, the color band is a R band, a G band, and a B band formed on the retina, when using RGB colored lights. A visual angle is uniquely determined by a reference point (a coupling point) of an eyeball and a band width of 1 colored light that is formed on the retina (no visual distance dependency). Rv is an eyeball circle movement rate (degree/second), and is an angular velocity at a time when the line of sight is moving from a certain point to other point. An image projected on a retina of an inner surface of an eyeball along with this line of sight movement moves with the same angular velocity (eyeball circle movement rate). Accordingly, the eyeball circle movement rate and the retina shifting rate (retinal velocity) are equivalent. Vf is a color spatial frequency of the visual system (cycle/degree), and represents how may cycles of the RGB color band will be formed in the visual angle of 1 degree. For example, if 1 color band of the RGB is formed respectively in the visual angle of 1 degree, it becomes 1 cycle/degree (cpd), if 5 color bands are formed respectively, then it becomes 5 cpd. This is commonly used as an index for indicating a resolution in general, and as narrowing the band width, the color discrimination (identifying discrimination of color), and the luminance discrimination (light and dark discrimination of the brightness) are reduced.

Figure 3:
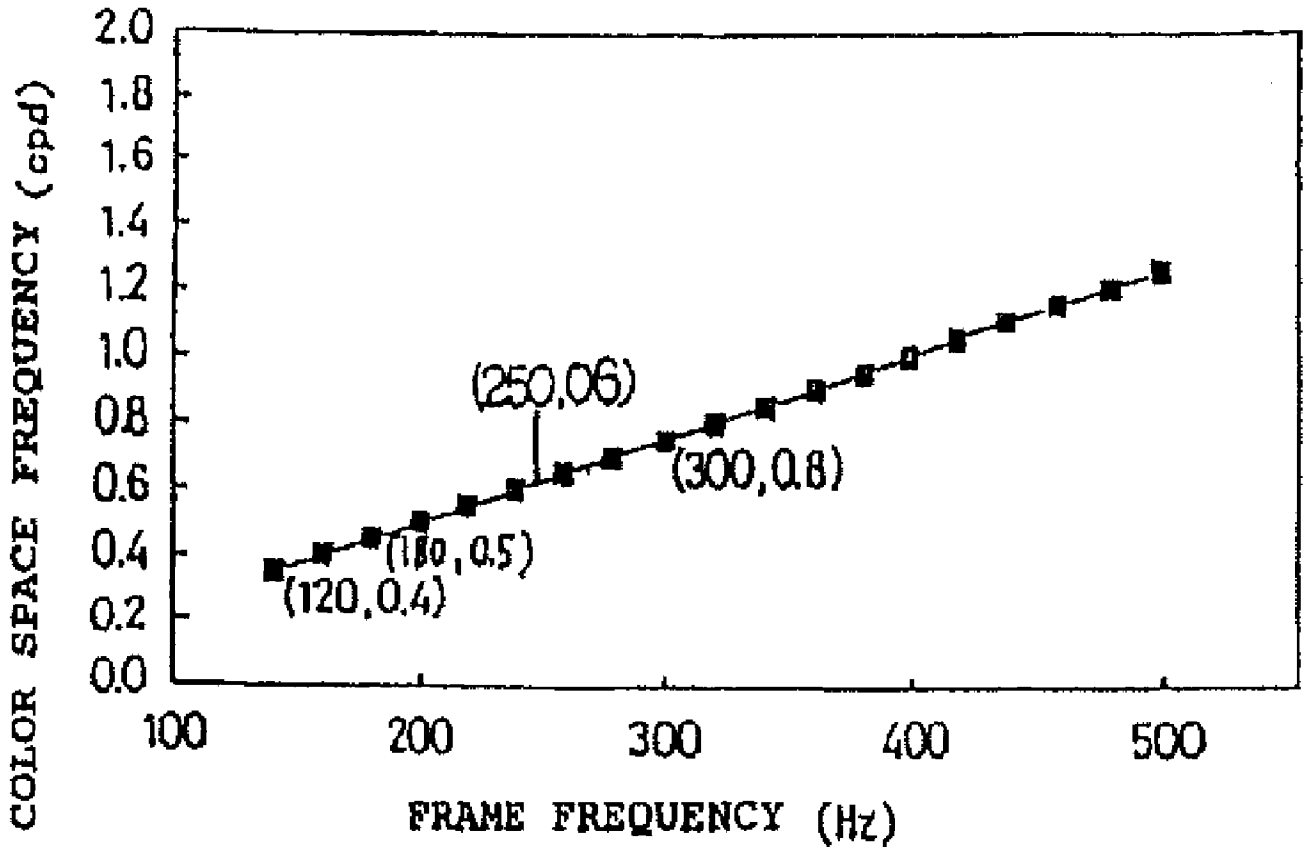
FIG. 3 is a graph showing the relationship of a frame frequency and a color spatial frequency of a visual system.

FIG. 3 is a graph showing the relations of the frame frequency and the color spatial frequency of the visual system as being converted using the above-mentioned equations (1), (2), and (3). Further, in the figure, (120, 0.4) shows the present level of the projection display device using the color sequence driving system, and (180, 0.5) or more, preferably (250, 0.6) or more, further preferably (300, 0.8) or more shows the frame frequency levels to be used in the color display device of the present embodiment.

In the following, using the experimental apparatuses shown in FIGS. 4 and 5, a method of obtaining a relation of the retina shifting rate (retinal velocity) and the frame frequency.

Figure 4:
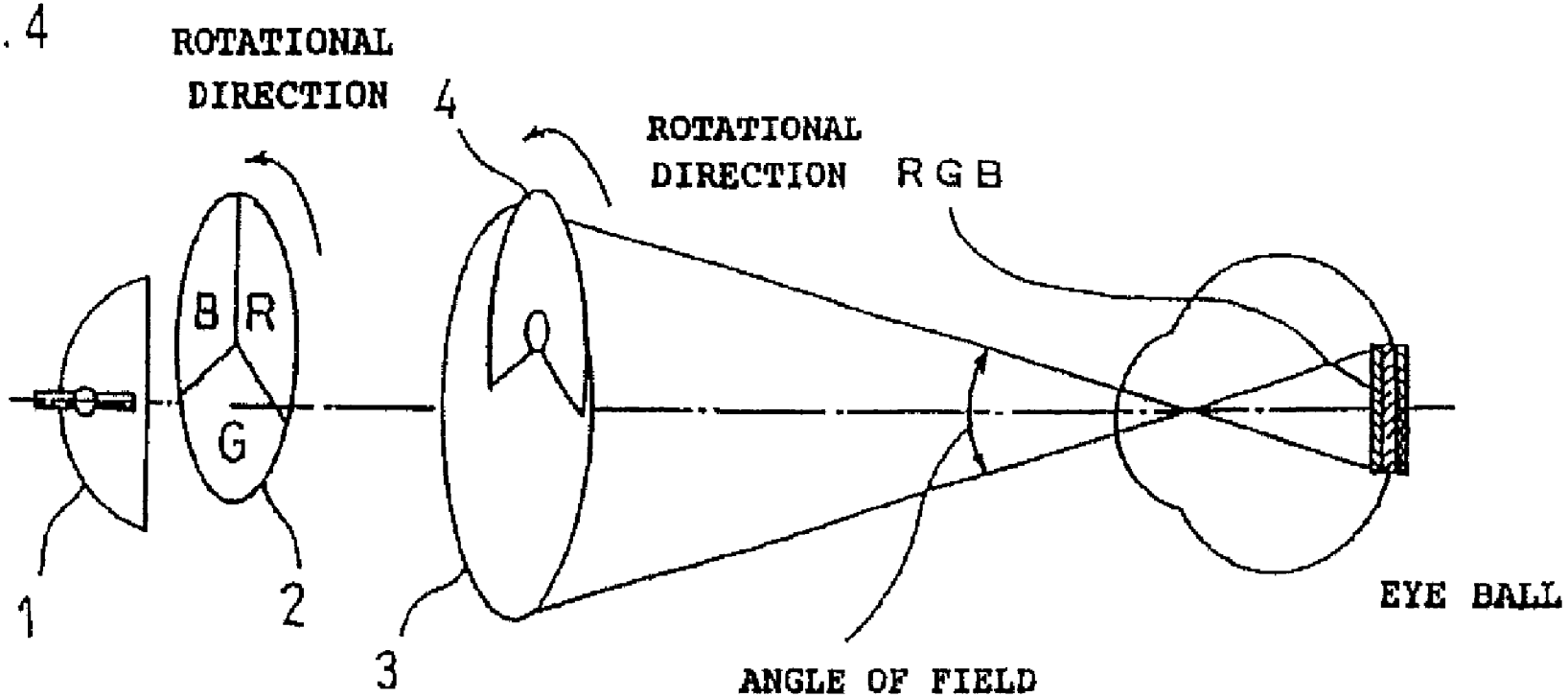
FIG. 4 is an illustrative drawing showing an experimental arrangement to obtain a relation of a retina shifting rate and a frame frequency.

The experimental apparatus shown in FIG. 4 is constituted of a light source 1 for emitting a white light, a RGB rotary filter 2 for spectra-generating RGB three colored lights from the light of the light source, a screen 3, and a chopper blade 4 for generating a retinal shifting rate. In this experimental apparatus, temporally a R colored light, a G colored light, and a B colored light are generated sequentially by passing the white light emitted from the light source 1 through the RGB rotary filter 2, and these colored lights are entered on the screen 3 from the rear. Then, the time spatial color band is generated by rotating the chopper blade 4 that is placed in front of the screen 3. An observer will fixate a predetermined one point on the screen 3 from a constant distance, and a color band is image-formed on the retina. Then, the perceived psychological color breakup is judged by a subjective evaluation. Moreover, by making the rotational rate of the RGB rotary filter 2 to be variable, an arbitrary frame frequency can be set, and by making the rotational rate of the chopper blade 4, which is placed in front of the screen 3 variable, an arbitrary retina shifting rate can be set.

Figure 5:
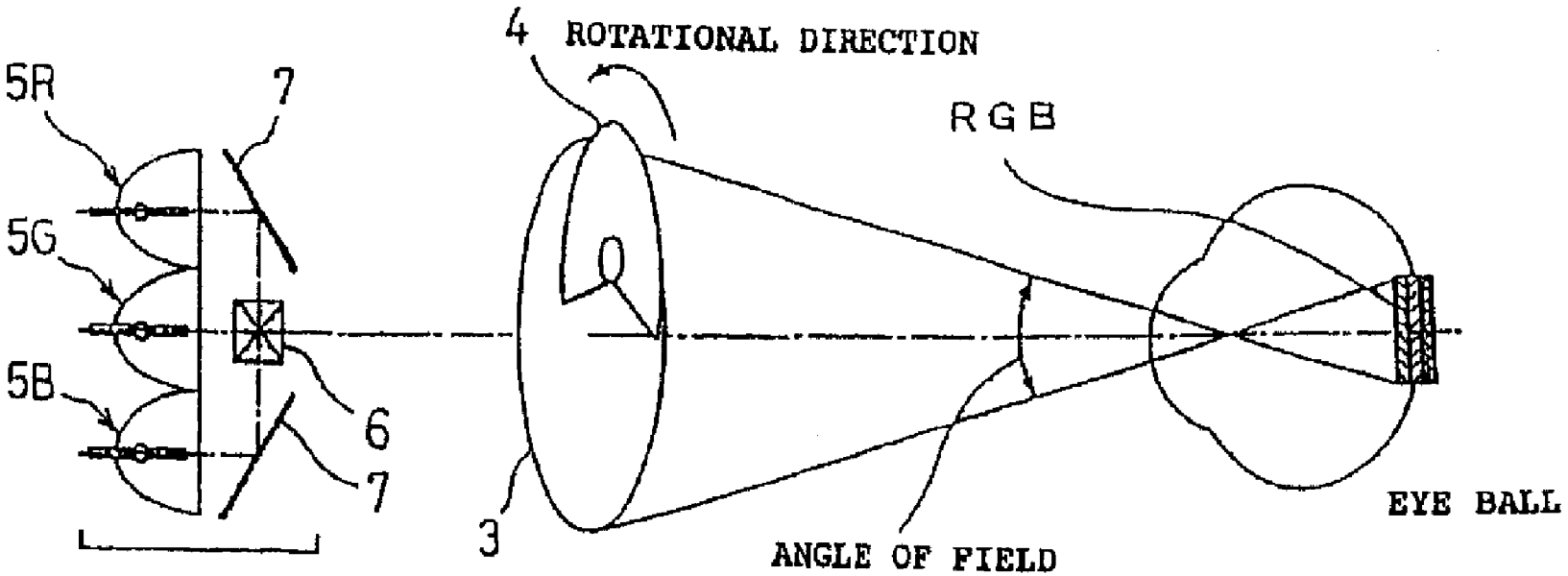
FIG. 5 is an illustrative drawing showing an alternative example of the experimental arrangement to obtain the relation of the retina shifting rate and the frame frequency.

The experimental apparatus of FIG. 5 is a configuration in which the light source 1 and the RGB rotary filter 2 that generate the RGB colored lights in FIG. 4 are replaced with the color sequence driving illumination system constituted of a dichroic prism 6 in which a R light source 5R, a G light source 5G, a B light source 5B, a red colored light selective reflection layer and a blue colored light selective reflection layer are formed in a X-letter shape, and a mirror 7 which reflects the red colored light and blue colored light from the R light source 5R, the B light source B to the prism 6 side. The respective light sources 5R, 5G, 5B are lit in sequence and from the dichroic prism 6 three colored lights are incident on the screen 3 in sequence from the rear. In this experimental apparatus, an arbitrary frame frequency can be set by making switching of the lighting of the R light source 5R, the G light source 5G, the B light source 5B to be variable. Other structure and operations are the same as those of the experimental apparatus shown in FIG. 4. Further, in the experimental apparatuses of FIGS. 4 and 5, they may be constituted as the order of the colors such as RGB, RBG, BGR and the like may be changed.

Figure 6:
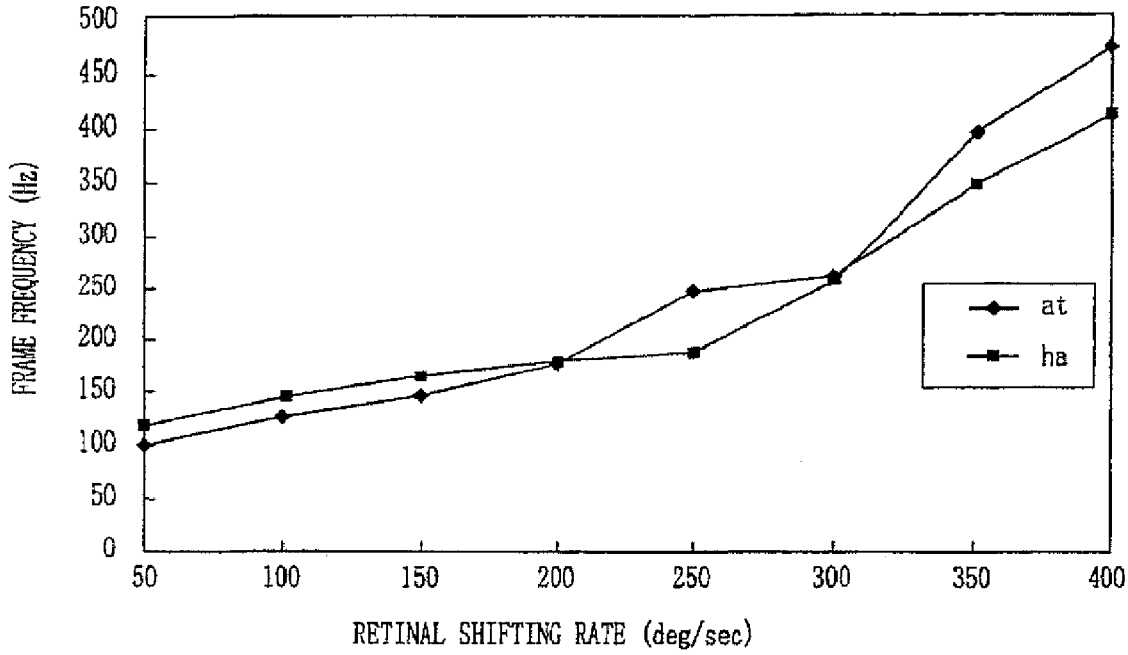
FIG. 6 is a graph showing optimal frame frequency characteristics of a visual system.
Figure 7:
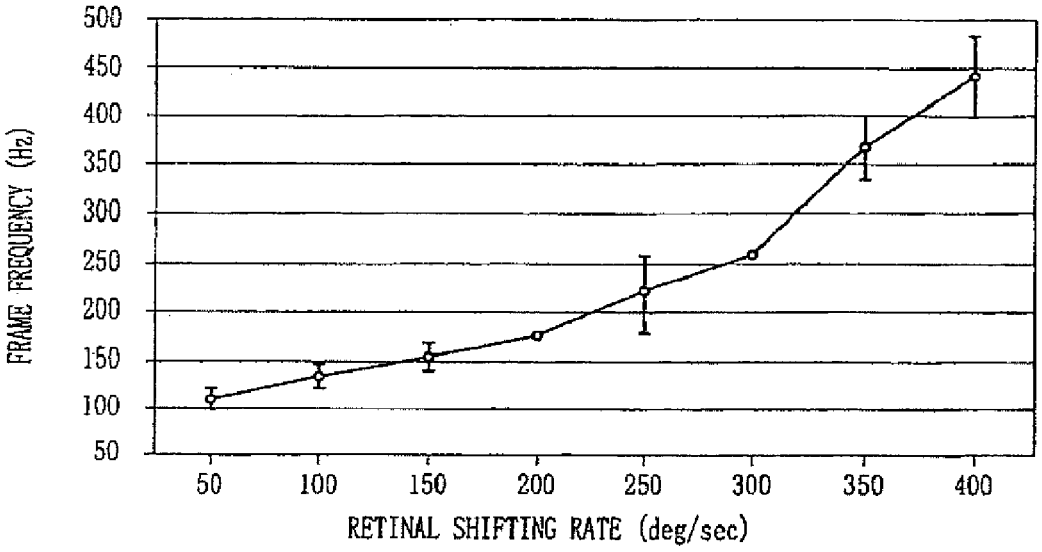
FIG. 7 is a graph showing optimal frame frequency characteristics of a visual system.

The relations of the retina shifting rate and the frame frequency that are obtained from the result as conducted for two subjects using these experimental apparatuses are shown in FIGS. 6 and 7. FIG. 6 is a graph showing the individual data, and FIG. 7 is a graph in which an average and a standard deviation are obtained based on the individual data.

As can be seen from FIGS. 6 and 7, the psychological color breakup perceptions show the different tendencies (2 phase property) with the retina shifting rates being roughly less than 300 deg/sec and 300 deg/sec or more, and a sharp start of a frame frequency is for 300 deg/sec or more. As for eye movement, there are four kinds, a following movement, an intermittent movement, a convergent/divergent movement, and an involuntary eye movement. For example, following a flying fly is a low rate eye movement of about 30-35 deg/sec. On the other hand, the intermittent movement is an intermittent high speed jump movement, and is an eye movement to compensate a shifting rate of the subject beyond the rate of the following movement, that can be seen for example, in the line of sight shifting at a time when reading a book, and is a high speed eye movement with 300 deg/sec or more. From these, it may be interpreted such that the retina shifting rate 300 deg/sec is equivalent to the intermittent movement, and as a frame frequency it is sufficient to secure 250 Hz or more on the graph, however when taking measurement accuracy and individual differences of the subjects and the like into account, it is more preferable to secure 300 Hz or more.

Figure 8:
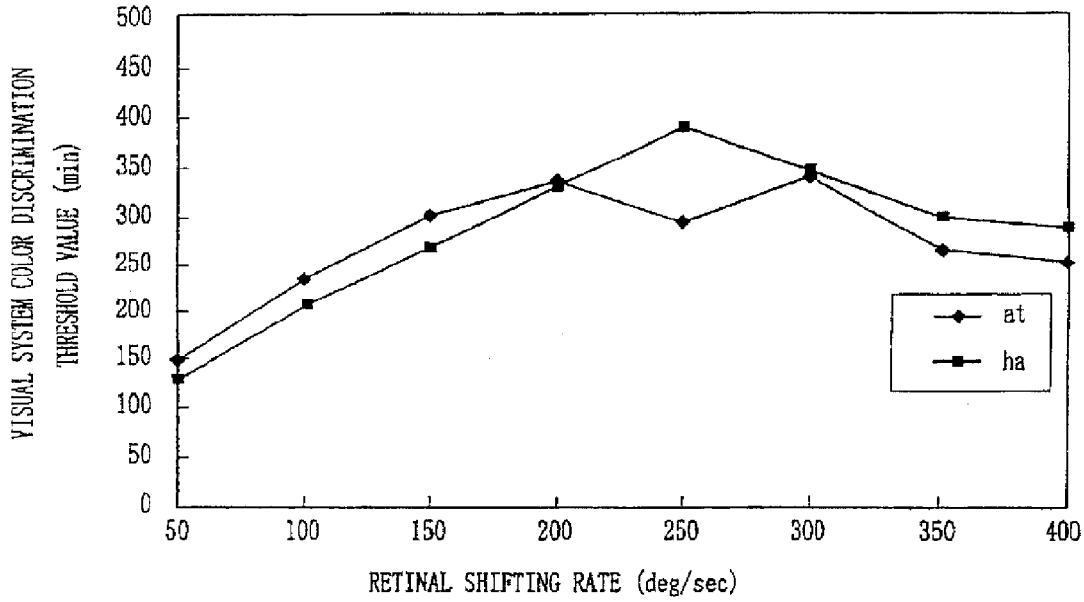
FIG. 8 is a graph showing color discrimination threshold value characteristics of a visual system.
Figure 9:
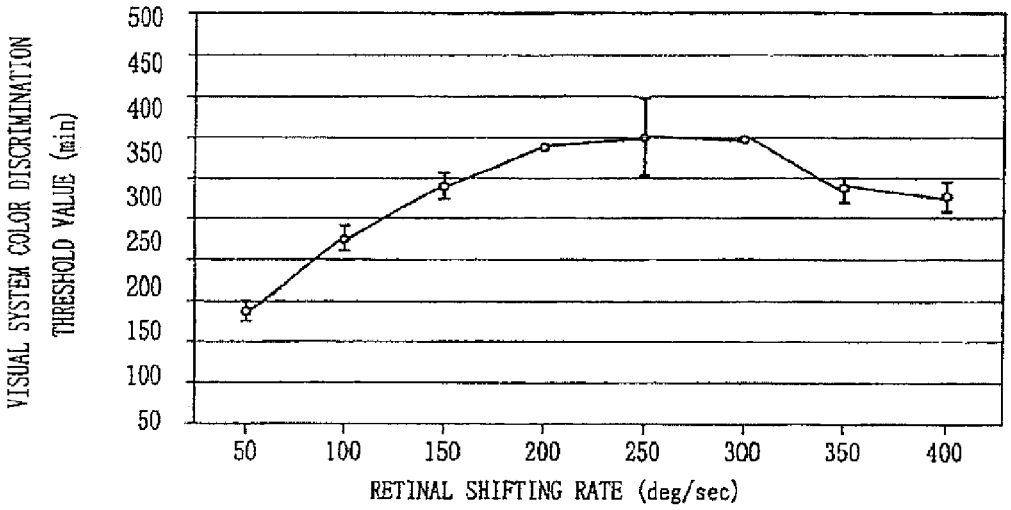
FIG. 9 is a graph showing color discrimination threshold value characteristics of a visual system.

FIGS. 8 and 9 are, the relations of the frame frequency and the retina shifting rate obtained from the above-mentioned experiment, the ones in which the frame frequency is inverted to the color discrimination threshold value of the visual system. Further, although there is no general definition for the color discrimination threshold value of the visual system, herein it is defined as the one in which the frame frequency obtained from the perceived psychological color breakup threshold value as a time spatial characteristic in the experiment is inverted to the physical RGB color band width that is simply spread out on the retina.

According to the graphs of FIGS. 8 and 9, the differences in the characteristics of the color discrimination threshold value of the visual system are realized with the retina shifting rates of 50-200 deg/sec, 200-300 deg/sec, and 300 deg/sec or more. The eye movements that can be considered as relevant to these data are two kinds, the low rate following movement of about 30-35 deg/sec such as, for example, following a flying fly with an eye and high speed intermittent movement with 300 deg/sec or more that alertly captures the subject that suddenly appears intermittently as being separated and compensates the shifting rate of the subject beyond the rate of the following movement. Moreover, in general, the eye movement rates of 200 deg/sec or more and less than 300 deg/sec among the eye movement rates (equivalent to the retina shifting rates) of the independent variables (horizontal axis) of the data shown in FIGS. 8 and 9 do not exist. However, the eye movement rates with 200 deg/sec or more and less than 300 deg/sec may be considered to exist as movement of the subject will shift on the retina, since the presentation using the projection display device and the like, for example, there are occasions that a presenter and/or an object that is moved by the presenter make various kinds of actions in front of the screen in a state being seen from the observer of the display scene. With the eye movement rates in these ranges, the color sensitivity of the visual system of a person who watches the screen is lowered. From the above, it may be assumed that the retina shifting rate influences the change of the color discrimination threshold value of the visual system.

In the color display device according to the present first embodiment, as described above, directing the attention to the range of the retina shifting rates (200 deg/sec or more and 300 deg/sec) in which the color sensitivity of the visual system is lowered, and making the frame frequency (color generation frequency) corresponding to the range of retina shifting rates 180 Hz or more from FIGS. 8 and 9, the perception of the psychological color breakup can be reduced or eliminated even if the presenter or the object performs various kinds of actions in front of the screen.

Further, when the frame frequency of the color display device according to the present first embodiment is the frame frequency (color generation frequency) that satisfies the maximum rate of eye movement that exists, i.e., it is 300 Hz higher than 250 Hz, it enables not only to prevent a perception of the above-mentioned color breakup but also reduces or eliminates the perception of the psychological color breakup that occurs in the color sequence driving system.

In the color display device 10 of the present first embodiment, a high quality color display can be implemented on the screen since a phenomena in which the color breakup as such is perceived can be controlled. As a result, according to the present first embodiment, at a time when observing an image on the screen 16, an observer will not sense an incongruity of the image, and thus an excellent color image is displayed with less fatigue. Moreover, in the color display device 10 of the present first embodiment, since a color display can be implemented with a single electro-optical device (modulator) 14, i.e., it is applicable to the projection display device of a single plate system, so that a light weight and lower cost projector can be implemented.

(Second Embodiment)

Figure 10:
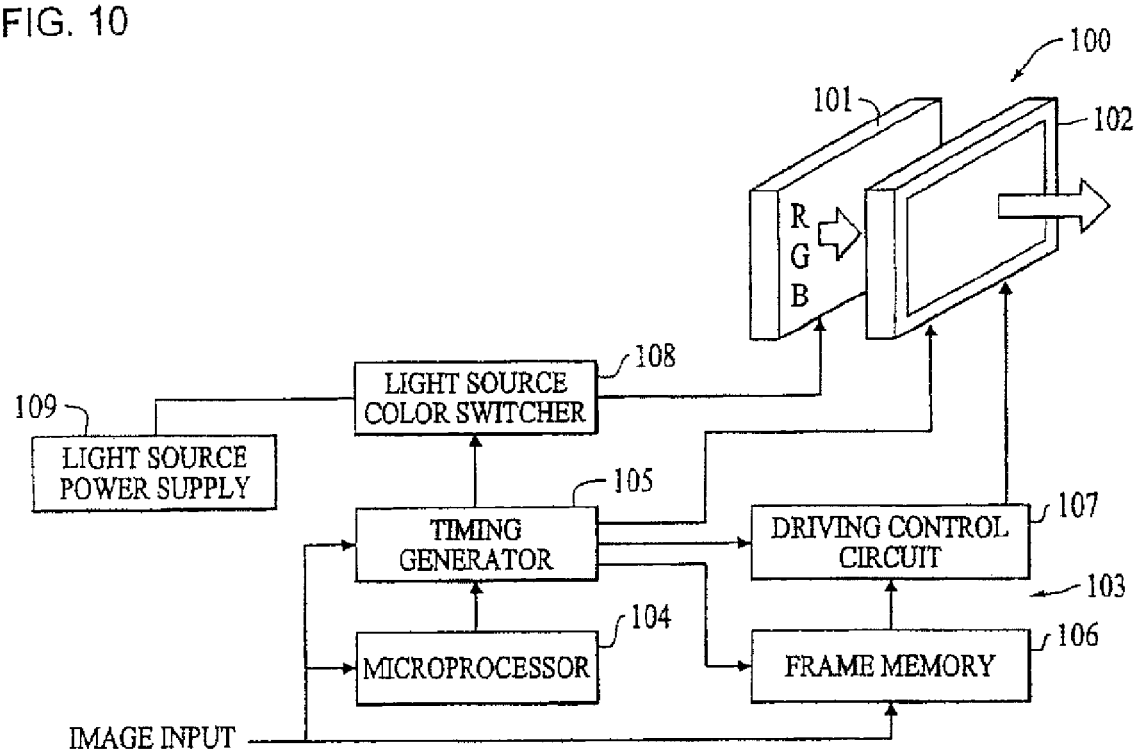
FIG. 10 is an illustrative configuration drawing showing the second embodiment of the color display device according to the present invention.

FIG. 10 shows a second embodiment of the color display device and a color display method according to the present invention. The present embodiment is one in which the present invention is applied to a direct viewing color display device constituted of an illumination device. The present embodiment is one in which the repetition frequency (frame frequency) of three colored lights that are emitted from the rear side in the color sequence is controlled so as to be 250 Hz or more, preferably 300 Hz or more, and a timing of a color image generation in the electro-optical device as the image generation unit is set to be matched with the generation timing of the respective colored lights.

As shown in FIG. 10, the color display device 100 of the present second embodiment, may consist of an illumination light source 101 in which a color switching type back-light is used, an electro-optical device 102, and a driving circuit for driving and controlling the color switching type back-light illumination light source 101 and the electro-optical device 102. In FIG. 10, since the illumination device is set as the back-light type, it is arranged as a transparent type electro-optical device, and thus it would be better to use a transparent type liquid crystal display device, for example.

A configuration of the color switching type illumination light source 101 may consist of, for example, a red light emitting light source, a green light emitting light source, and a green light emitting light source not shown, and is arranged to uniformly irradiate the colored lights emitted therefrom onto a display zone of the transparent type electro-optical device 102 through a light guide plate not shown, for example.

Moreover, as each of the light sources as the illumination light sources, it is possible to apply the various kinds of light emitting source of colored lights, such as a fluorescent tube e.g., a cold-cathode tube, a hot-cathode tube, EL (Electroluminescence) light-emitting device, a LED and the like. When selecting the back-light system, a configuration in which the light source is placed in the rear of the electro-optical device 102, a configuration in which, a configuration in which a light guide plate is placed in the rear and a light source is placed on a side thereof is set to be an illumination light source 101, and then propagating the light of the light source on the light guide plate and then illuminating the electro-optical device 102 from the rear, and the like can be considered. Also, not the back-light system, but a front-light system may be possible, and when the electro-optical device 102 is set to be the reflection type electro-optical device, a configuration in which the light guide plate is placed on a front side thereof, and the illumination light source is placed on the side thereof is set to be the illumination light source 101. A structure of the reflection type electro-optical device 102 is the same as the constitution described in the first embodiment.

As the electro-optical device 102 described above, a liquid crystal display device in which a monochrome display is implemented without using a color filter and similar to the first embodiment can be used, and for example, the various kinds of liquid crystal display devices having high speed response characteristics, for example, such as a liquid crystal panel of $\pi$ cell mode, a liquid crystal panel in which a cell gap of the TN liquid crystal is set to be narrowed, and a liquid crystal panel of the OCB mode and the like can be applied.

The driving circuit 103 may consist of a microprocessor 104, a timing generator 105, a frame memory 106, a driving control circuit 107, a light source switcher 108, and a power supply for use in light source 109. In this color display device 100, the switching timing of the light source color switcher 108 and the driving timing of the electro-optical device 102 are controlled with the timing generator 105. First, an image signal is sampled with a sampling circuit which is not shown in figure, as well as a synchronizing signal in the image input signal is sent to the microprocessor 104 and to the timing generator 105. At the same time, image data in the image signal is arranged to be written into the frame memory 106 with timing that is controlled by the timing generator 105. The color switching type illumination light source 101 is a light source color switcher 108 that is controlled by the timing generator 105 as to be synchronized with the driving timing of the respective color images of the electro-optical device 102, and a red light emitting light source, a blue light emitting light source, and a green light emitting light source not shown in the figure and lit repetitively in a time sequence. In this way, with the color switching type illumination light source 101, the colored lights are generated in the color sequence corresponding to the display data color, and it is arranged to be illuminated on the transparent type electro-optical device 102. The colored lights (lights for use in display) of the respective colors irradiated as such, are implemented with a light modulation by the transparent type electro-optical device 102, and then a color image display is implemented in the color sequence.

For example, as the illumination light source 101 light-emits a red colored light, a light switching timing signal is supplied to the light source color switcher 108 from the timing generator 105, and for the selected light source a power supply is made from the power supply for use in light source 109, and then the light source of the red colored light is lit. Synchronizing with a switching timing in this light source color switcher 108, a read-timing signal is supplied to the frame memory 106 from the timing generator 105, the image data of the red component that is stored in advance during the driving period prior to the present is read sequentially, and the driving control circuit 107 which receives that image data drives each of pixels of the electro-optical device 102 in response to the image data for use in the red component. The timing generator 105 is the one, which implements a timing-control so as to synchronize the timing of the respective elements upon receiving a control of the microprocessor 104. The electro-optical device 102 is a modulation element which is constituted of a liquid crystal panel as described above, and in which pixels constituted of pixel electrodes are arranged in a matrix, and a red colored light is modulated for each pixel, and then an image of the red colored light is generated. Accordingly, an image is displayed on the display screen by the red colored light of which a light intensity is modulated for each pixel.

Then, with a timing of lighting the light source of the green colored light in the illumination light source 101, as similar to the case of the red colored light, image data for use in green colored light is read from the frame memory 16, and in response thereto, each of the pixels of the electro-optical device 102 are driven in response to the image data thereof, and by modulating the blue colored light, an image of the green colored light is projected and displayed on a display screen of the electro-optical device 102, Then, with a timing of lighting the light source of the blue colored light in the illumination light source 101, is the same. As described above, images of three colored lights are generated sequentially with the electro-optical device 102, and by repeating this in a cycle, a color image is displayed. Further, an order of generating the colored lights is not limited to the present embodiment, it may be any order.

Herein, when the electro-optical device 102 is a transparent type liquid crystal panel, the liquid crystal illustrated previously is sandwiched between a pair of substrates, having a transparent pixel electrode for each pixel in the substrate on the opposite side, and changing an effective voltage that is applied to a liquid crystal layer from this pixel electrode in response to the image data, then emitting by changing the plane of polarization and/or the scattering angle of the incident light in response to a change in an array of the liquid crystal molecules in the liquid crystal layer. When changing the plane of polarization, incident light entering through a polarization element, displaying a reflected light through the polarization element, a light intensity is modulated for each pixel. When a change of light scattering (in a case that the liquid crystal is a high polymer dispersion type), a light intensity is modulated for each pixel in accordance with the degree of the scattering, so that the polarization element is no longer necessary.

Further, in the present embodiment, although it is to be the transparent type electro-optic device, it may be a color display device for generating an image with the reflection type electro-optic device constituted of the reflection type liquid crystal panel. In this case the pixel configuration is to be the configuration similar to the one described in the first embodiment. Moreover, in case of the reflection type liquid crystal panel, it enables the installation of memory (frame memory 106) for each pixel and a driving control circuit 107 for supplying a voltage to the pixel electrode in response to the memory content thereof below the reflection type image electrode.

In the present embodiment as such, a repetition frequency (frame frequency) of three colored lights of the illumination light source is lit, switch controlled by the timing generator 105 so as to be 250 Hz or more, preferably 300 Hz or more, as well as a timing of a color image generation in the electro-optical device 102 is set so as to be matched with a generation timing of the respective colored lights.

In the present embodiment, as a result of implementing the color sequence driving with the frequency such as described above, even if the eye movement occurs at a time when observing a display screen of the display device that is constituted of the electro-optical device, perceived color breakup can be reduced or eliminated, as a result the color display image will not have a sense or an incongruity and thus an excellent color display image is obtained, with less fatigue.

(Third Embodiment)

Figure 11:
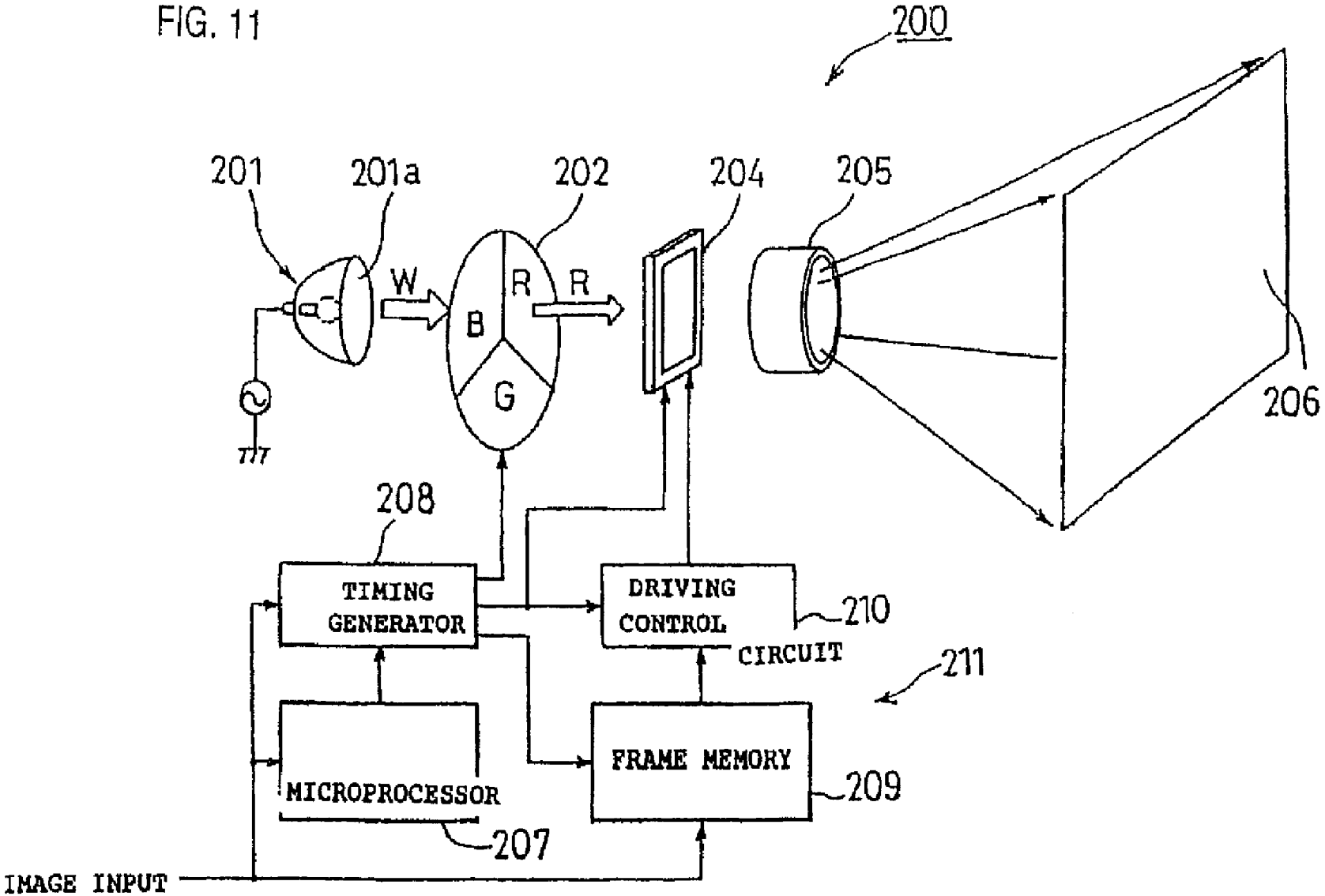
FIG. 11 is an illustrative configuration drawing showing the third embodiment of the color display device according to the present invention.
Figure 12:
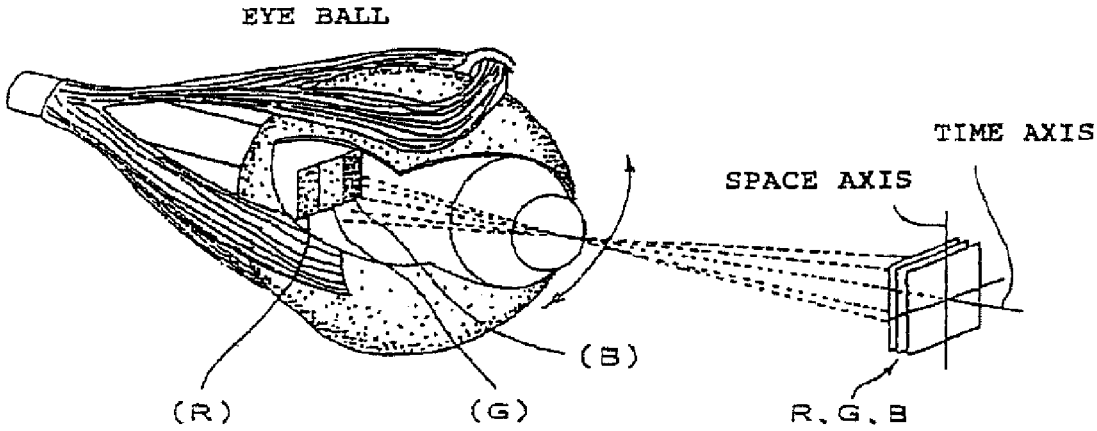
FIG. 12 is an illustrative drawing showing a mechanism by which a color band is formed on a retina by an eye movement.
Figure 13:
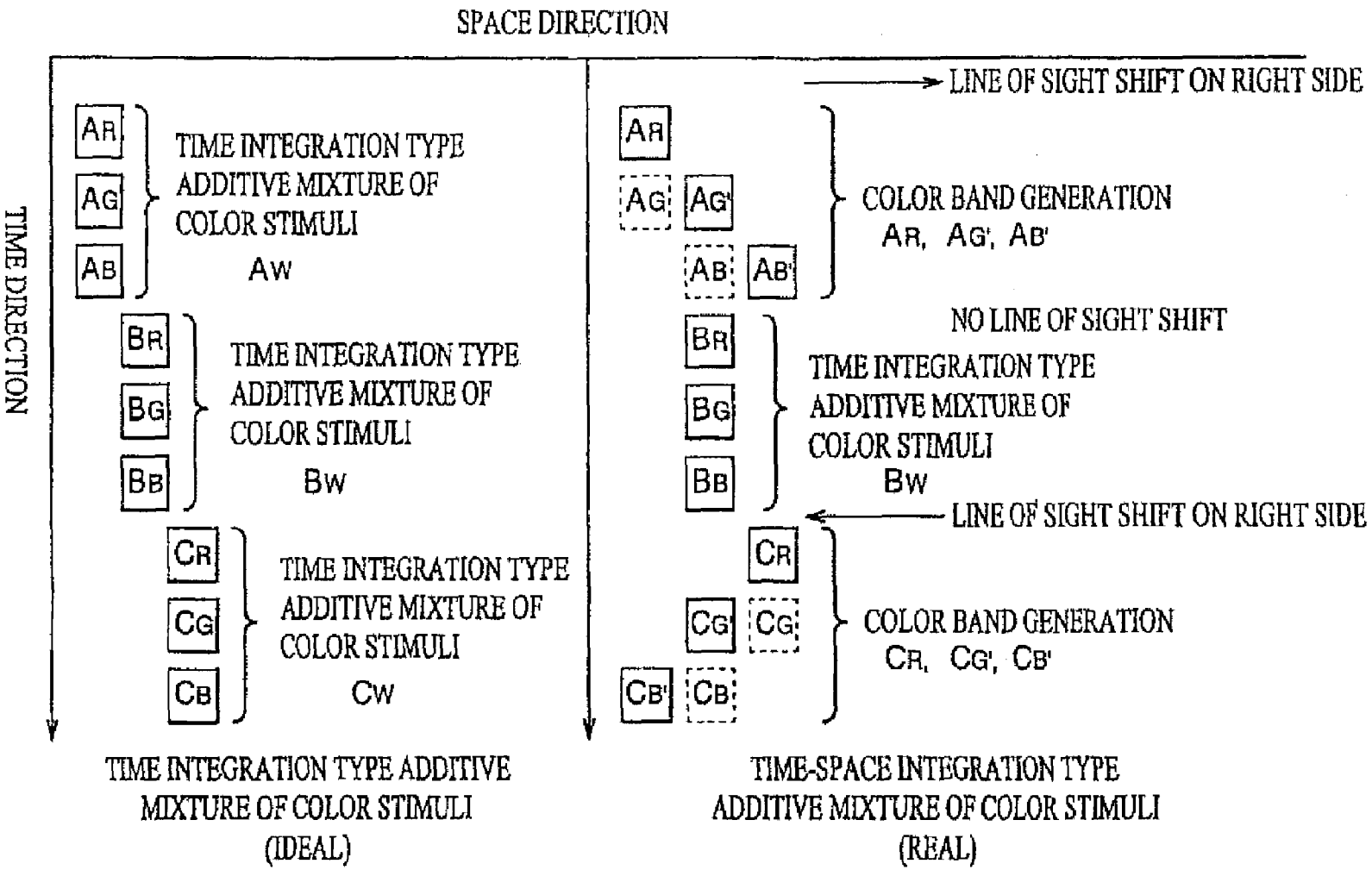
FIG. 13 is an illustrative drawing showing a color image generation model with a color sequence driving system.
Figure 14:
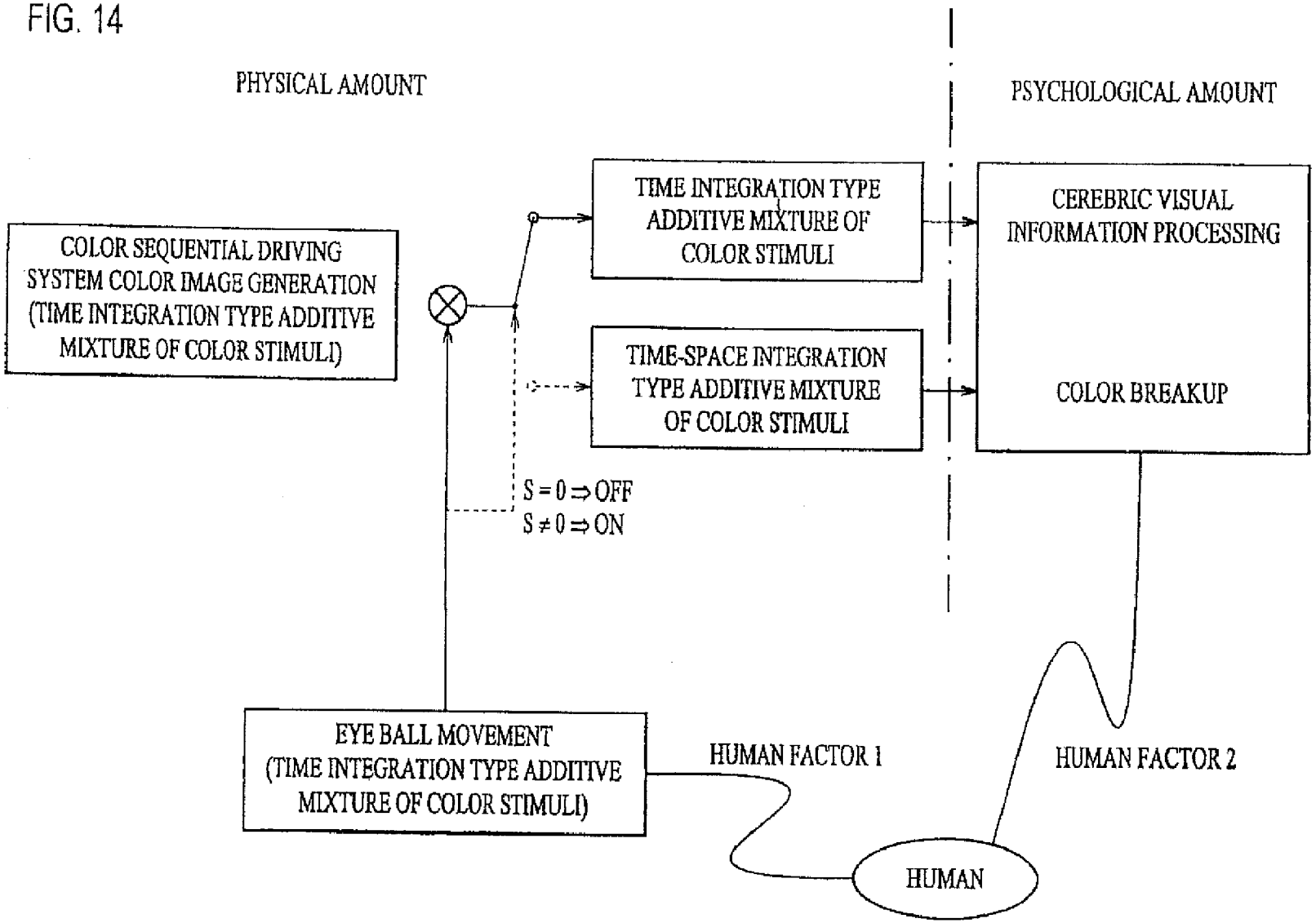
FIG. 14 is an illustrative drawing showing a color image generation model with a combination of a color sequence driving system and a visual system.

FIG. 11 shows a projection display device as a color display device of the present invention. The present embodiment differs from the first embodiment in the point that the electro-optical device 14 of the first embodiment is replaced with the transparent type electro-optical device 240, and other configuration and operation are the same as the first embodiment.

The projection display device 200 of the present embodiment may consist of a light source 201 for emitting a white light by emitting as including respective spectra of a red colored light, a blue colored light and a green colored light, a rotary color filter 202 being disposed in front of this light source 201 and having areas of color elements for red, blue and green, a transparent type electro-optical device 204 disposed in front of the rotary color filter 202 for generating a color image corresponding to a color of a colored light incident, and a projection lens 205 for performing a projection upon receiving a light that is modulated/reflected in the electro-optical device 204, and an image is displayed as an image generation colored light which is projected from the projection lens 205 onto a screen 206. In the light source 201, it is also provided a reflector 201*a* for reflecting a light from the light source as shown.

Similar to the previous first embodiment, an observer who watches an image projected onto the screen 16 might watch the projected image situated in front of the screen 16 if the color display device is a front projection type, or situated in rear of the screen 16 if the color display device is a rear projection type. In a presentation using a projection display device, a presenter (human being) stands in front of the screen 16 as being viewed from the observer, and describes as pointing out the projected display screen, using an object such as a finger or an indication stick. Accordingly, from the view point of the observer, an action of the presenter or the object in front of the screen 16 is performed as blocking the display screen.

As the electro-optical device 204, the various kinds of modulators having high-speed response characteristics, such as a ferroelectric liquid crystal panel, an antiferroelectric liquid crystal panel, a liquid crystal panel of a $\pi$ cell mode, a liquid crystal panel in which a cell gap of a TN liquid crystal cell is set to be narrowed, and a liquid crystal panel of a OCB mode and the like as a reflection type liquid crystal light valve, can be applied thereto.

Further, the projection display device 200 as such mainly may consist of a driving circuit 211 constituted of a microprocessor 207, a timing generator 208, a frame memory 209, and a driving control circuit 210. In this projection display device 200, it is controlled by synchronizing a rotary drive of the rotary color filter 202 and to driving timing of the transparent type electro-optical device 204 with the timing generator 208. First, an image signal is sampled with a sampling circuit, which is not shown in figure. Then, a synchronizing signal in the image input signal is sent to the microprocessor 207 as well as the timing generator 208. At the same time, it is arranged that an image data in the image signal be written into the frame memory 209 with a timing that is controlled by the timing generator 208. It is arranged that the white light emitted from the light source 201 passes through a three-color rotary color filter 202 that rotates in synchronization with the driving timing of the electro-optical 204 by the timing generator 208, the colored lights are generated by sequentially observing spectra of/passing through a red light, a blue light, and a green light from the light source, and then are irradiated onto the electro-optical device 204. For each of the colored lights irradiated as such, a light modulation is implemented as passing through the electro-optical device 204 and is enlarged and projected by the projection lens 205, and then is image-formed on the screen 206 so as to implement a color image display.

For example, for synchronizing with a timing of which the light from the light source 201 passes through a red zone of the rotary color filter 202, in response to the reading timing signal supplied from the timing generator 208, the image data of the red component that is stored in advance during the driving period prior to the present is read sequentially, from the frame memory 209, and the driving control circuit 210 which receives that image data drives each of the pixels of the electro-optical device 204 in response to the image data for use in the red component. The timing generator 208 is the one, which implements a timing-control so as to synchronize the timing of the respective elements upon receiving a control of the microprocessor 207. The electro-optical device 204 is a modulation element which is constituted of a liquid crystal panel, and in which pixels are arranged in a matrix, and a red light is transmitted for each pixel, and a modulation is made along with this transmission, and then a red colored image is generated. Accordingly, a red colored light of which a light intensity is modulated for each pixel is incident on the projection lens 205, and an image of a red colored light is projected and displayed on the screen 206.

Then, with a timing of the light from the light source passing through a blue zone of the rotary color filter 202, similar to the case of the red colored light, the image data for use in the blue colored light is read from the frame memory 209, and in response thereto, each pixel of the electro-optical device 204 is driven in response to the image data thereof, a blue colored light is modulated, and an image of a blue colored light is projected and displayed on the screen 206. Then, with a timing of which the light from the light source passes through a green zone of the rotary color filter 202, it is the same as above. As described above, images of three colored lights are generated sequentially with the electro-optical device 204, and by repeating this cycle, a color image is displayed. Further, the order of generating the colored lights is not limited to the present embodiment, it may be any order.

In the present embodiment as described above, the rotation is controlled by the timing generator 208 so that the repetition frequency (frame frequency) of the three colored lights of the rotary color filter 202 is equal to or greater than 180 Hz, preferably equal to or greater than 250 Hz, more preferably equal to or greater than 300 Hz. Also, the timing of color image generation of the electro-optical device 204 is set so as to match the generation timing of the respective colored lights.

In an aspect of the present embodiment, as similar to the first embodiment, by performing color sequence driving with a frequency as described above, the display for reducing the color identification sensitivity of the visual system can be implemented, and at a time when watching the screen 206, even if an eye movement caused by an action of a presenter himself who performs a presentation standing in front of the screen 206 or a finger thereof, or an object such as an indication stick moved by the presenter occurs, perceived color breakup is reduced or eliminated. As a result, without sensing of an incongruity to the color display image, an excellent presentation can be made. Accordingly, in the present embodiment, an excellent color image is obtained without giving fatigue to the observers.

As such, it is described about the first to third embodiments, but the present invention is not intended to be limited to these, and various kinds of modulations to be accompanied with the gist of the configuration can be made. The present invention is that other than the above-mentioned embodiments, it is applicable to the various kinds of color display device such as a projection display device using a transparent type light valve, and a reflection type display device having the light sources in front of the display screen or the side thereof, and the like.

Further, in the present invention, a plurality of colored lights to be generated are described with the three colored lights of the red colored light, the blue colored light and the green colored light, but they may be the three colored lights of a cyan light, a magenta light and yellow light, or they may be two colored lights or may be a switching of a multi-colored lights of more than three colored lights.

In the first to third embodiments, by passing the light of the light source from one light source that emits the light from the light source including a plurality of colored lights (for example, three colored lights of the red colored light, the blue colored light, and the green colored light) components through the rotary color filter (12, 202), each of the colored lights is generated, but as in the color sequence driving illumination system of FIG. 5, it may be configured as providing a plurality of light sources (the light source of the red colored light, the light source of the green colored light, and the light source of the blue colored light) that generate each of the plurality of colored lights separately, and colored light generating by sequentially selecting the light source to be lit according to the sequence timing generator (18, 208). In that case, by implementing the drive of the timing control of the projection display device, the repetition frequency for generating the plurality of colored lights to be 180 Hz or more, preferably 250 Hz or more, and further preferably 300 Hz or more, the color breakup phenomena is reduced or eliminated.

INDUSTRIAL APPLICABILITY

The present invention provides a color display method and a color display device of a time-division driving system, in which the perception of color breakup caused by actions performed by the presenter, as well as the perception of the color breakup caused by eye movements are not generated.

The invention claimed is:

1. A color display device, comprising:

a colored light generation unit that repetitively generates a plurality of colored lights in a time sequence with a predetermined frequency; and an image generation unit that processes the plurality of colored lights so as to generate an image corresponding to each of the plurality of colored lights generated in the time sequence, the predetermined frequency being equal to or greater than 180 Hz and corresponding to a color spatial frequency of human visual system equal to or greater than 0.5 cycle/degree (cpd).

2. The color display device according to claim 1, the predetermined frequency being equal to or less than 10 cpd.

3. The color display device according to claim 1, the predetermined frequency being equal to or less than 4 cpd.

4. The color display device according to claim 1, the colored light generation unit comprising a light source, and a color filter that generates the plurality of colored lights from light coming form the light source.

5. The color display device according to claim 1, the colored light generation unit comprising a plurality of light sources that emits colored lights different from each other, the plurality of light sources turning on in the time sequence.

6. The color display device according to claim 1, the image generation unit being a reflection type spatial light modulator.

7. The color display device according to claim 6, the reflection type spatial light modulator being a liquid crystal device.

8. The color display device according to claim 6, the reflection type spatial light modulator being a digital micro-mirror device.

9. The color display device according to claim 1, the image generation unit being a transmission type spatial light modulator.

10. The color display device according to claim 1, further comprising a lens that projects light modulated by the image generation unit.

11. A projector, comprising:

a colored light generation unit that repetitively generates a plurality of colored lights in a time sequence with a predetermined frequency;

an image generation unit that processes the plurality of colored lights, so as to generate an image corresponding to each of the plurality of colored lights generated in the time sequence, the predetermined frequency being equal to or greater than 180 Hz and corresponding to a color spatial frequency of human visual system equal to or greater than 0.5 cycle/degree (cpd); and a lens that projects light modulated by the image generation unit.

12. The projector according to claim 11, the predetermined frequency being equal to or less than 10 cpd.

13. The projector according to claim 11, the predetermined frequency being equal to or less than 4 cpd.

14. The projector according to claim 11, the colored light generation unit comprising a light source, and a color filter that generates the plurality of colored lights from light coming form the light source.

15. The projector according to claim 11, the colored light generation unit comprising a plurality of light sources that emits colored lights different from each other, the plurality of light sources turning on in the time sequence.

16. The projector according to claim 11, the image generation unit being a reflection type spatial light modulator.

17. The projector according to claim 16, the reflection type spatial light modulator being a liquid crystal device.

18. The projector according to claim 16, the reflection type spatial light modulator being a digital micro-mirror device.

19. The projector according to claim 11, the image generation unit being a transmission type spatial light modulator.

20. A color display method, comprising:

repetitively generating a plurality of colored lights in a time sequence with a predetermined frequency; and modulating a light intensity of the plurality of colored lights generated in the time sequence in response to an image data corresponding to the plurality of colored lights, so as to generate an image corresponding to each of the plurality of colored lights generated in the time sequence, the predetermined frequency being equal to or greater than 180 Hz and corresponding to a color spatial frequency of human visual system equal to or greater than 0.5 cycle/degree (cpd).

* * * * *